United States Patent [19]

Hutchins

[11] Patent Number: 4,671,020

[45] Date of Patent: Jun. 9, 1987

[54] POWER SANDER WITH PAD CONTAINING AIR-FLOW PASSAGES

[75] Inventor: Alma A. Hutchins, Pasadena, Calif.

[73] Assignee: Hutchins Manufacturing Company, Pasadena, Calif.

[21] Appl. No.: 878,070

[22] Filed: Jun. 23, 1986

[51] Int. Cl.[4] ..... B24B 23/00

[52] U.S. Cl. ..... 51/170 MT; 51/273

[58] Field of Search ..... 51/170 MT, 170 R, 170 TL, 51/273, 358, 389

[56] References Cited

U.S. PATENT DOCUMENTS

| | | | |
|---|---|---|---|
| 3,815,292 | 6/1974 | Hutchins | 51/170 MT |
| 3,824,689 | 7/1974 | Hutchins | 30/368 |
| 4,052,824 | 10/1977 | Hutchins | 51/170 MT |
| 4,355,487 | 10/1982 | Maier et al. | 51/170 MT |

OTHER PUBLICATIONS

National-Detroit, Inc. Brochure of Model 400 and Model 150 on p. 2—Other Models Disclosed on pp. 3 and 4, Hutchins Manufacturing Co., Catalog, H84, The Pro Finishers.

Photographs 1 and 2 Showing the Different Layers of Material Forming Some of the Hutchins Sanding Tool Pads in Separated Condition Photographs 3 and 4 Showing Prior Art Sanding Head.

Three Advertising Sheets Entitled "Double Action Sander", Double Action Sander (Dust Free Type), and Orbital Sander (Dust Free Type) Advertising Sheet of Hutchins Manufacturing Co., Model 4500 and Model 4950VA.

National-Detroit, Inc. Advertising Sheet of Model 400.

*Primary Examiner*—Roscoe V. Parker

*Attorney, Agent, or Firm*—William P. Green

[57] ABSTRACT

A power driven sanding tool having a resiliently deformable backing pad to which a sheet of sandpaper is attached and by which the sandpaper is actuated to abrade a workpiece, with the pad containing internal passages through which a flow of air and abraded particles are drawn by suction from a location near the workpiece to a dust collection bag or the like, and with the pad containing an element more rigid than the deformable cushioning material of the pad and adapted to prevent deformation of the cushioning material by the force of the suction to thus avoid constriction of the air-flow passages by the force of the suction.

25 Claims, 10 Drawing Figures

FIG. 1
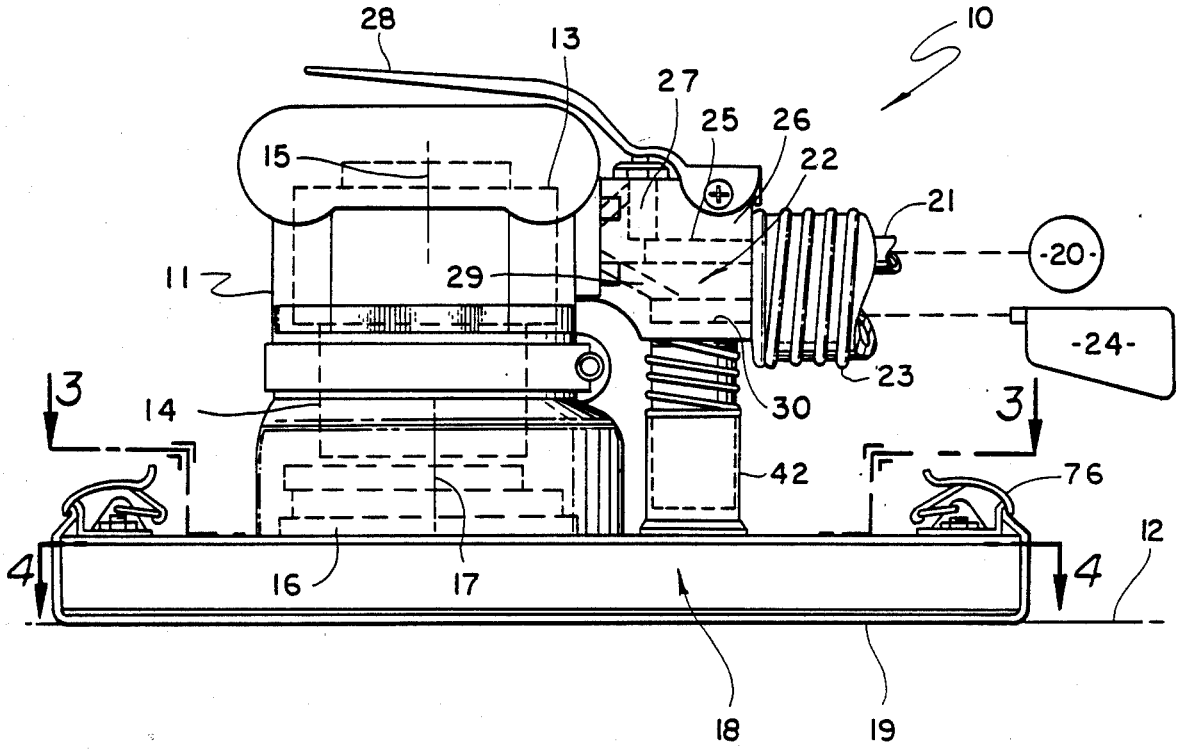
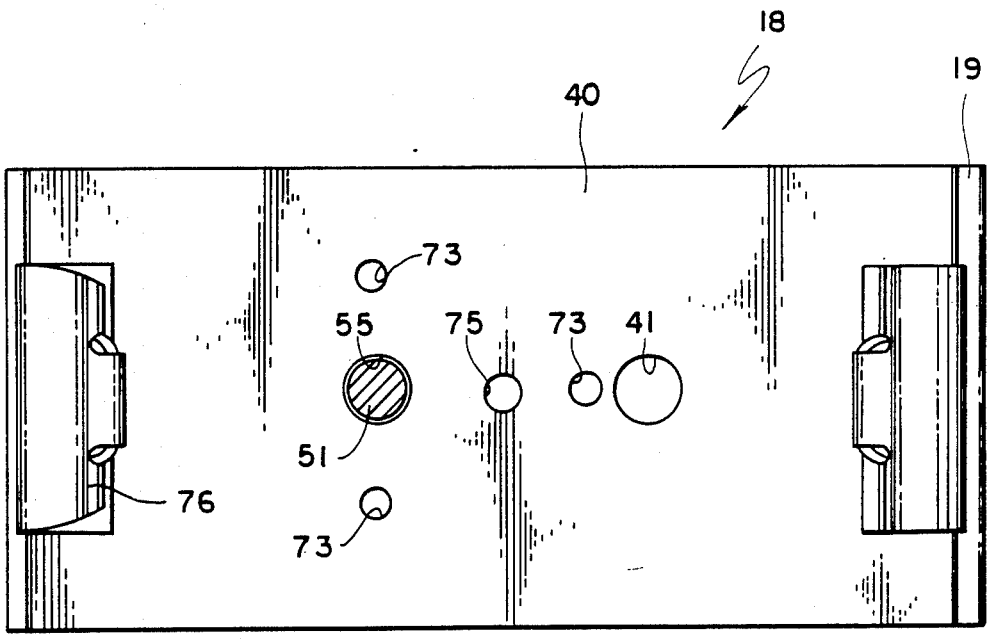
FIG. 3

FIG. 4
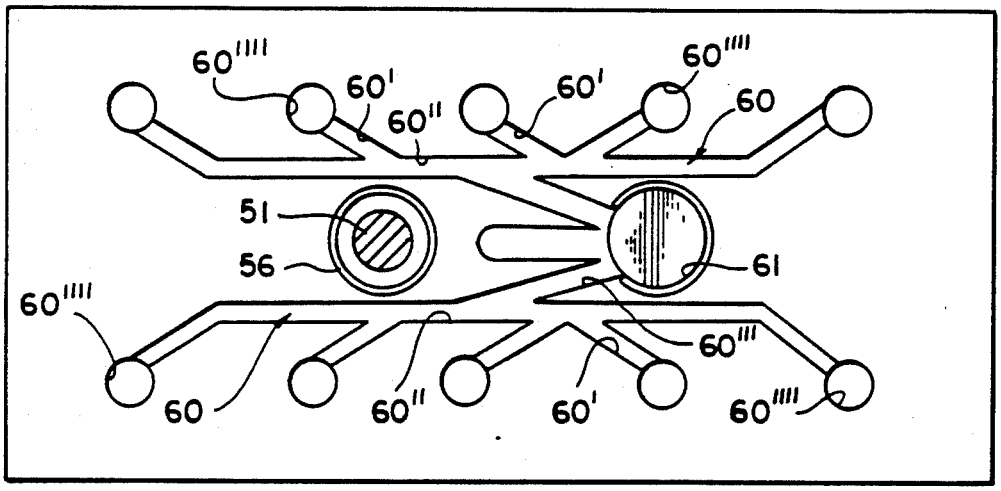
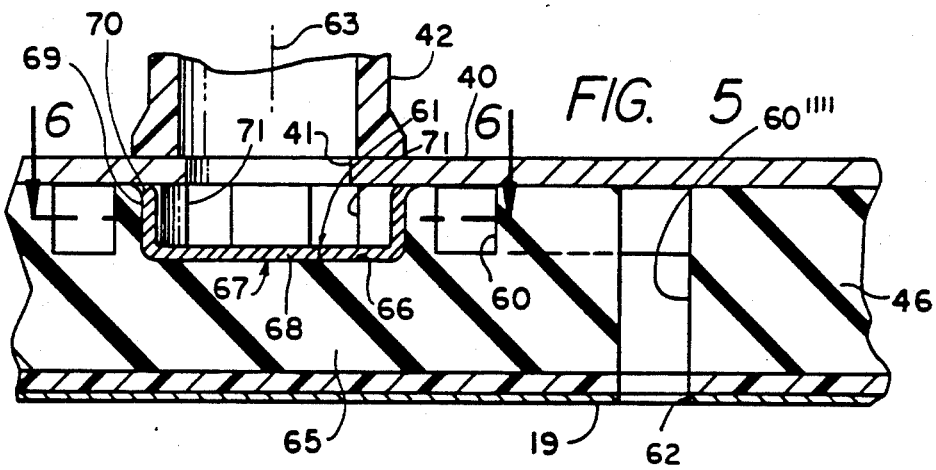
FIG. 5
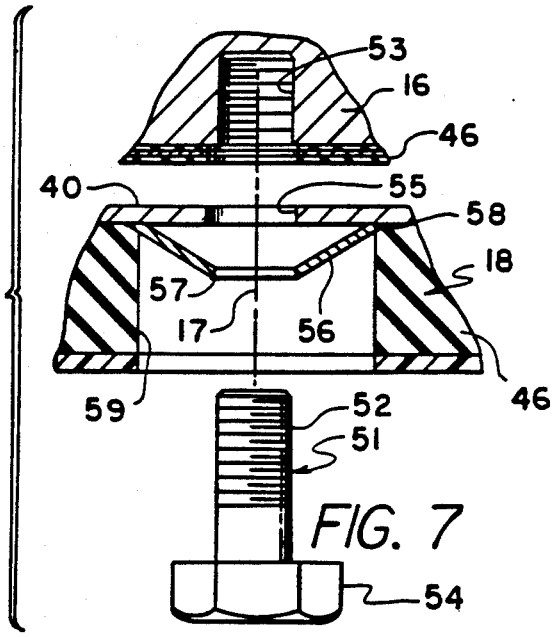
FIG. 7
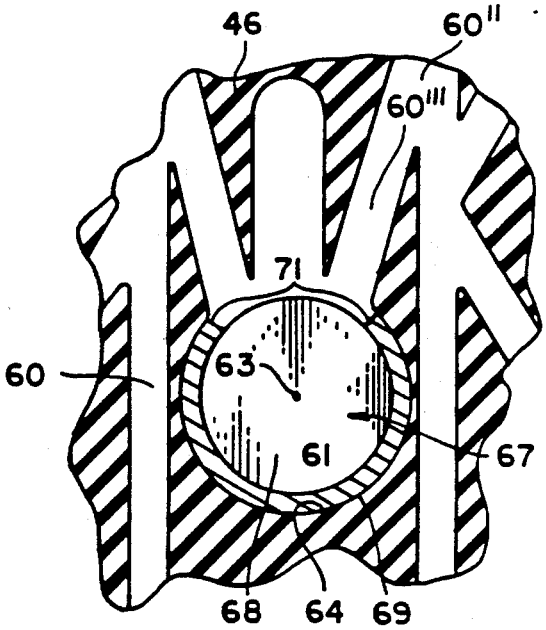
FIG. 6

POWER SANDER WITH PAD CONTAINING AIR-FLOW PASSAGES

This invention relates to improved portable power operated sanding tools.

BACKGROUND OF THE INVENTION

There have in the past been provided portable power operated sanders having suction systems for creating a vacuum induced flow of air from a location near the tool and near the work surface being sanded, in a manner carrying particles abraded from the work surface to a bag or other container within which the particles are collected. In some instances, the air and abraded particles are drawn through passages formed in a power driven backing pad which carries a sheet of sandpaper and which is actuated with the sandpaper to perform the abrading operation. Devices of this type have been shown in my pending patent application Ser. No. 6/830,574 filed Feb. 18, 1986 on "Portable Power Operated Sander". The pads disclosed in that application include cushions which may be formed of a foam material, and which are resiliently deformable to cushion the forces applied to the sandpaper in use, with the air-flow passages extending through that deformable pad material to a location at which a suction system can withdraw the air and entrained abraded particles for delivery to a discharge location.

SUMMARY OF THE INVENTION

If a sanding tool of the above discussed type, having air-flow passages extending through a flexible backing pad of the device, is subjected to an excessive vacuum, the force of that vacuum may tend to deform the flexible cushioning material of the backing pad in a manner restricting the flow of air and abraded particles through the pad and adversely affecting the dust removing function. A major purpose of the present invention is to provide means in the pad which will counteract this flow restricting characteristic, and thus assure maintenance of the air-flow passages in completely open condition at all times.

The air-flow passages in the cushioning material of the backing pad direct the flow of air and particles to a discharge recess formed in the upper portion of the cushion and from which the air and particles are drawn upwardly by the force of the vacuum for ultimate delivery to a collection bag or the like. The concentration of suction force at the point of this discharge recess tends to draw the flexible bottom wall of the recess upwardly, and in this way restrict the flow of air through the recess and upwardly from the pad. To prevent this adverse effect, the present invention provides means at the location of the recess for resisting vacuum induced deformation of the recess walls in a flow constricting manner. These means desirably include an element which is stiffer than the deformable cushioning material of the backing pad, and which resists deformation of the cushioning material at the location of the recess. The element may be received within the recess above the flexible bottom wall thereof, and maintain that wall against upward deformation. In addition, the element may have side walls projecting upwardly from the bottom wall toward the top of the recess.

The flexible cushioning material of the pad may be carried by a rigid backing plate, adapted to be secured to the driving mechanism of the sander. This plate preferably contains an opening above the discussed recess in the cushioning material, through which opening the flow of air and abraded particles discharges upwardly. The reinforcing element within the pad may be located beneath the mentioned opening in the backing plate, with the side walls of the reinforcing element projecting upwardly toward the plate and about the opening.

The pad may be attached to the drive mechanism of the sander by a single threaded screw, which can extend upwardly through an opening in the backing plate of the pad and connect threadedly into a driving element of the sander. An additional feature of the invention relates to the provision of improved means for assuring maintenance of the connection formed between the pad and the remainder of the sander by this screw. For this purpose, the pad desirably carries a lock washer, preferably of the belleville spring type, which is engaged and deformed by the head of the screw in a manner frictionally retaining the screw against accidental loosening as a result of the vibrational forces encountered in use.

BRIEF DESCRIPTION OF THE DRAWINGS

The above and other features and objects of the invention will be better understood from the following detailed description of the typical embodiments illustrated in the accompanying drawings in which:

FIG. 1. is a side elevational view of a first form of sander embodying the invention;

FIGS. 3 and 4, are horizontal sections taken on lines 3—3 and 4—4 respectively of FIG. 1;

FIG. 5 is an enlarged fragmentary transverse section taken on line 5—5 of FIG. 2;

FIG. 6 is a fragmentary horizontal section taken on line 6—6 of FIG. 5;

FIG. 7 is a fragmentary view similar to a portion of FIG. 2, but showing the pad and attaching screw removed from the powered portion of the tool;

DESCRIPTION OF THE PREFERRED EMBODIMENTS

Figure 2:
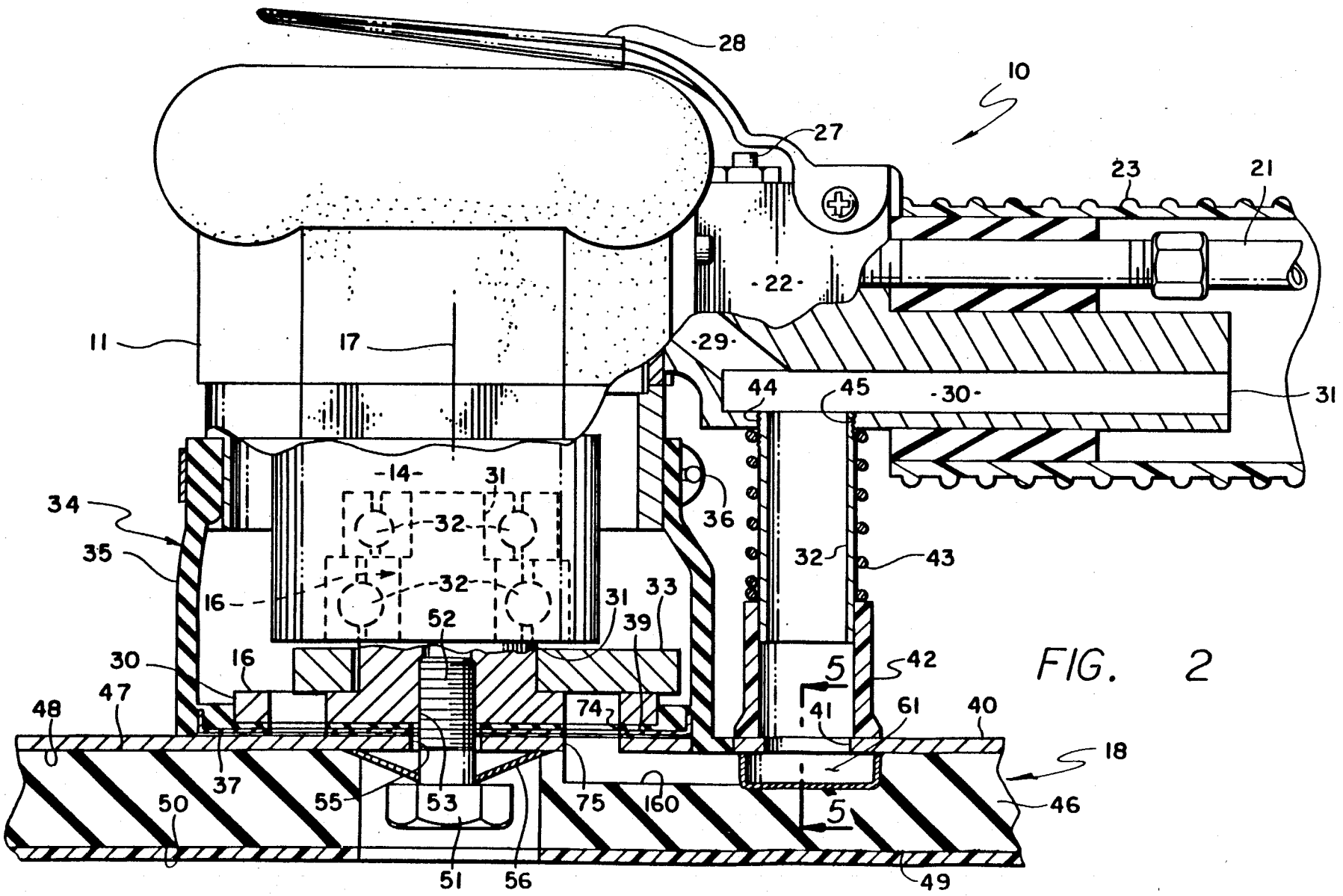
FIG. 2 is an enlarged view of the sander, partially in elevation as in FIG. 1, and with the lower portion illustrated in section.

With reference first to FIGS. 1 through 7, the tool 10 shown in those figures is a power driven orbital sander having a body structure 11 shaped externally as a handle to be grasped by a user for holding the tool and moving it along a typically horizontal work surface 12 to sand or polish that surface. An air driven motor 13 contained within the body structure 11 drives a carrier part 14 rotatively about a vertical axis 15, with a part 16 being connected to carrier 14 for rotation relative thereto about a second vertical axis 17 offset slightly from and parallel to axis 15, in a relation driving an abrading pad or shoe 18 and a carried sheet of sandpaper 19 orbitally about axis 15 to sand the surface 12. Air is supplied to motor 13 from a source 20 of compressed air through a line 21 connecting into the rear of body structure 11. Exhaust air and particles abraded from the work surface are discharged by an aspirator 22 through a hose 23 leading to a dust collection bag or container 24. The air delivered to motor 13 flows from inlet line 21 through a passage 25 in a block 26 attached to the handle body 11 of the device, with a valve 27 in the block being actuated manually by a lever 28 to control the delivery of air to the motor in a manner starting and stopping the operation of the sander. Air exhausted from the motor flows through an inclined second passage 29 in block 26, which forms part of the aspirator structure 22. The exhaust air flows from this passage 29 into a horizontally extending passage 30, to advance rapidly in a rightward direction as viewed in FIG. 2 through that passage 30 and ultimately discharge at 31 into the interior of hose 23 for flow therethrough to the collection bag 24. The rightwardly flowing air from passage 29 passes generally horizontally across the upper end of a vertical tube 32, to create a vacuum in the upper end of that tube acting to draw air and abraded particles upwardly from the sanding pad 18, for admixture with the main flow of exhaust air from passage 29 and delivery therewith to collection bag 24.

The orbitally driven part 16 may have a lower horizontally extending flange portion 30 which may be circular about the axis 17 of that part. Projecting upwardly from flange 30, part 16 has a shaft portion 31 centered about and extending upwardly along axis 17, and which is journalled within carrier part 14 by bearings typically represented at 32 to enable the previously mentioned rotation of part 16 relative to part 14 about axis 17. A counterweight 33 may be connected to flange 30 to balance the eccentricity of part 16 and the other connected parts with respect to the principal axis 15 of motor 13.

A shroud or boot 34 forms an enclosure about the orbital drive mechanism of the device, and may have an essentially tubular generally vertically extending side wall 35 formed of rubber or other resiliently deformable elastomeric material and secured at its upper end by an annular clamp 36 to a lower portion of the handle body 11 of the tool. At the lower end of side wall 35 of shroud 34, the shroud may have a horizontally extending bottom wall 37 formed of elastomeric material containing a rigid preferably metal reinforcing plate 39 for stiffening the bottom wall of the device and facilitating its connection to the orbitally moving drive element 16 of the device.

The sanding pad or shoe 18 includes a rigid preferably metal backing plate 40, which is typically of rectangular horizontal section as seen in FIG. 3, and which contains a circular opening 41 through which air and abraded particles are drawn upwardly into tube 32. The upper surface of plate 40 is contacted slidably by the lower end of a second tube 42, which is received about and engages tube 32 telescopically to form a seal about opening 41 confining the flow of air and entrained particles within the interior of the telescopic tube assembly 32–42 for delivery to aspirator discharge passage 30. A coil spring 43 disposed about tube 32 bears upwardly against the bottom of block 22 and downwardly against the upper end of tube 42, to yieldingly urge the horizontal bottom surface of tube 42 downwardly against the upper horizontal surface of plate 40 to maintain the seal at that location about opening 41. The upper end of tube 32 may be attached to block 22 in any convenient manner, preferably by providing threads 44 on the exterior of the upper end of tube 32 for engaging mating threads formed in the interior of opening 45 in the bottom of block 22 to form a rigid connection therebetween.

Secured to the underside of the top backing plate 40, pad 18 includes a cushion 46 of resiliently deformable material through which forces are applied to the sandpaper sheet 19 in a manner cushioning contact of the sandpaper with the work surface 12. The cushion 46 is preferably formed of a closed pore foam, desirably polyurethane foam, or the like. The upper horizontal surface 47 of cushion 46 may be bonded to the horizontal undersurface 48 of the more rigid backing plate 40. At its underside, cushion 46 may have a horizontal surface 49, to which a flexible sheet of material 50 may be adhered. This sheet 50 bears directly against the sandpaper sheet 19, and is preferably a fabric backed layer of polyvinyl chloride. The sandpaper may be secured to the pad by clips represented at 76.

Pad 18 is rigidly but detachably secured to the orbitally movable drive element 16 of the tool by a screw or bolt 51, having a threaded shank 52 which is connectable into a correspondingly threaded bore 53 in part 16 centered about axis 17. Shank 52 extends through an opening 55 in backing plate 40 of the sanding pad 18, with an enlarged head 54 of screw 51 being tightenable upwardly against a belleville washer or spring 56 carried by the pad to apply upward clamping force to the backing plate 40 of the pad through the belleville washer. This washer 56 has the slightly conical configuration illustrated in FIG. 7, being centered about axis 17 and flaring upwardly to an increased diameter from a lower small diameter edge 57 engaged by head 54 of screw 51 to an upper larger diameter edge 58 engaging backing plate 40 of the pad. Screw 51 may extend upwardly through a typically cylindrical opening 59 in the resiliently deformable cushioning material 46, with the belleville washer 56 being located at the upper end of that passage 59 and preferably having its annular upper or outer edge portion 58 of a diameter somewhat greater than that of passage 59 and received and confined vertically between plate 40 and the upper surface of pad 46, in a manner effectively holding the belleville washer or spring in the FIG. 7 position relative to parts 40 and 46 of the pad for handling as a unit with the other parts of the pad prior to connection of the pad to the drive portion of the tool. When the screw is connected upwardly to the position of FIG. 2, the screw applies compressive force to the belleville washer causing that washer to function as a lock washer acting to frictionally maintain the parts in assembled condition.

The cushioning material 46 of the pad contains a number of air flow passages 60 through which air and entrained particles abraded from the work surface are drawn from the vicinity of the work surface to a recess 61 formed in the upper surface of the pad directly beneath opening 41 and tubes 32 and 42. The passages 60 may include a number of horizontally extending passages 60', 60'' and 60''' formed in the upper surface of resilient cushion 46, and a number of vertical openings 60'''' communicating with horizontal passages 60' and extending downwardly through the material of cushion 46 and bottom sheet 50 to the underside of the pad. The sandpaper sheet 19 contains openings 62 registering with openings 60'''', to conduct a flow of air and particles upwardly through openings 62 and 60'''', and then through passages 60', 60'' and 60''' to recess 61 for induction upwardly by aspirator 22 into and through tubes 42 and 32 to discharge passage 30. The passages 60', 60'' and 60''' in the upper surface of cushion 46 are closed at their upper sides by plate 40 and may typically be arranged in the pattern illustrated in FIG. 4, or in any other convenient pattern selected to attain optimum air and particle flow characteristics.

As seen in FIG. 6, the recess 61 formed in cushion 46 beneath opening 41 in plate 40 may be circular about the vertical axis 63 of opening 41 but be of a somewhat larger diameter than opening 41. As a result, the recess may have a vertical cylindrical side wall 64 centered about axis 63. Beneath the recess, the resiliently deformable material of cushion 46 forms a bottom wall 65 of the recess, having an upper horizontal surface 66 extending perpendicular to vertical axis 63 and forming the bottom of the recess.

Contained within the recess, there is a reinforcing element 67 which is stiffer and more rigid than the material of cushion 46, and which prevents unwanted deformation of the cushioning material at the location of the recess if subjected to an excessive vacuum, as for example if a user employs an external or auxiliary suction system at the location of the collection bag 24 in addition to or in lieu of the aspirator device 22. Element 67 may be essentially cup shaped as shown, and is preferably formed of thin but relatively rigid sheet metal, such as steel, aluminum, or the like. The element 67 desirably has a circular horizontally extending planar bottom wall 68 extending across and contacting the upper horizontal planar surface 66 of bottom wall 65 of the recess. Projecting upwardly from the periphery of circular bottom wall 68 of element 67, that element has a side wall 69 which extends vertically and may be cylindrical about axis 63. The side wall 69 of element 67 is adjacent and engages and extends along the vertical side wall surface of recess 61, to prevent inward deformation of the vertical wall 64 of the recess. Side wall 69 of element 67 preferably projects upwardly to the location of the undersurface of plate 40, and has an upper edge 70 annularly engaging the undersurface of the plate to prevent upward movement of element 67. Element 67 is secured permanently in position within the recess 61, as by provision of an appropriate adhesive between the bottom wall 68 of element 67 and the cushioning material therebeneath, and between the outer surface of side wall 69 of element 67 and the surface 64 of the cushioning material. As seen in FIG. 6, the side wall 69 of element 67 is interrupted at a location 71, to allow flow of the air and abraded particles from passages 60''' into recess 61 through that interruption.

When the above described device of FIGS. 1 through 7 is in use, the aspirator 22 and/or an external suction system provided at the location of the bag 24 of FIG. 1 create a vacuum induced flow of air from the work surface through passages 60'''', 60', 60'' and 60''' into recess 61, and then upwardly from that recess through tubes 42 and 32 into passage 30 for ultimate delivery to the collection bag or external suction system 24. In the absence of element 67, excessive vacuum might tend to draw the bottom flexible wall 65 of recess 61 upwardly toward opening 41, in a manner constricting the flow of air and thus adversely affecting the dust pick-up action. Under extreme conditions, a high vacuum might move the bottom flexible wall 65 beneath opening 41 upwardly to contact the undersurface of plate 40 entirely about opening 41 and thereby completely close off all flow of suction air from the internal passages in cushion 46. When element 67 is present, on the other hand, that element positively prevents upward deflection of the bottom wall 65 of the recess, and thereby assures continuous maintenance of a completely open air-flow passage into and through recess 61 and to the aspirator.

Figure 8:
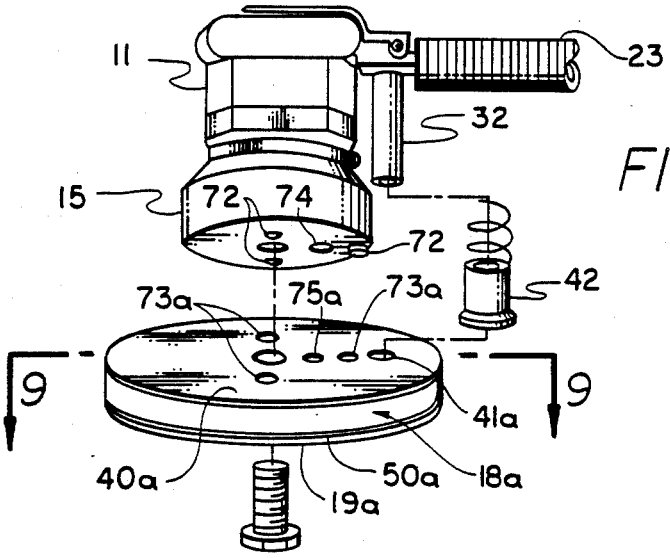
FIG. 8 is a somewhat diagrammatic exploded representation of a variational form of sander having a circular rather than rectangular sanding head.
Figure 9:
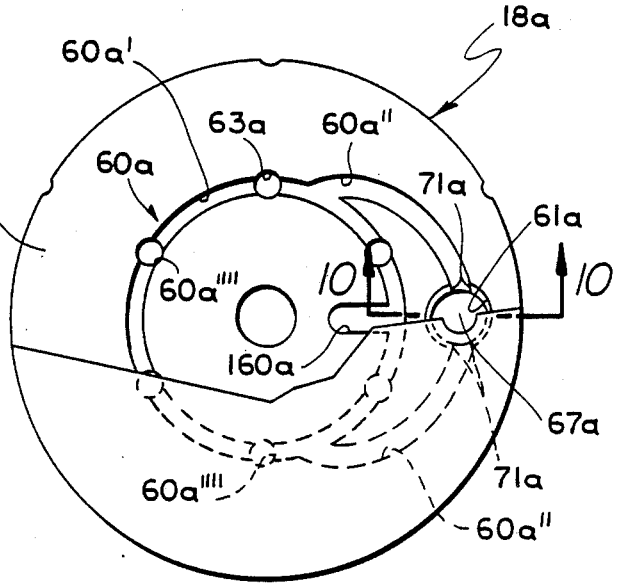
FIG. 9 is a view taken primarily on line 9—9 of FIG. 8, with the backing plate of the pad partially broken away.
Figure 10:
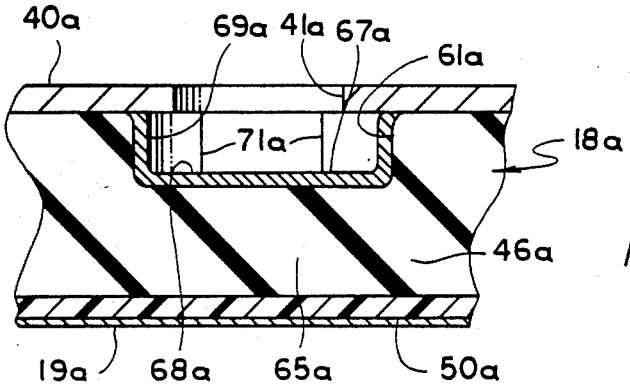
FIG. 10 is an enlarged fragmentary vertical section taken on line 10—10 of FIG. 9.

FIGS. 8 through 10 show a variational arrangement in which a circular sanding pad **18*a* is substituted for the rectangular pad 18 of the first form of the invention. The body 11 of the tool and carried motor, etc. may be the same as the first form of the invention, including the same shroud 15 and suction tubes 32 and 42. Pad 18*a* includes an upper circular rigid backing plate 40*a* corresponding to plate 40 of the first form of the invention and containing an opening 41*a* through which air and abraded particles are drawn upwardly into tubes 32 and 42. A circular cushion 46*a* of resiliently deformable material, desirably polyurethane foam, is adhered to the underside of backing plate 40*a* and may carry a flexible sheet of fabric backed vinyl material 50*a* at its underside, to which the sandpaper may be secured by adhesive in use. The cushion and sheet 50*a* contain air-flow passages 60*a* serving the function of passages 60 of the first form of the invention for leading a vacuum induced flow of air and entrained particles from the work surface through the interior of the cushion and to the location of a cylindrical recess 61*a* directly beneath air discharge opening 41*a*. As in the first form of the invention, the passages 60*a* in the pad may include vertical openings 60*a*'''' communicating with registering openings in a circular sheet 19*a* of sandpaper and leading upwardly from the underside of the cushion to passages 60*a*' and 60'', which are formed in the upper surface of the cushion and enclosed at their upper sides by plate 40*a* and lead to recess 61*a*. Passages 60*a*' may take the form of an essentially annular passage extending past the locations of the vertical opening 60*a*'''' and communicating through curved passages 60*a*'' with recess 61*a*. Within recess 61*a*, there is provided an element 67*a* corresponding to element 67 of the first form of the invention and having greater stiffness than the deformable material of the cushion 46*a*, and having a cup shaped configuration similar to element 67 to prevent vacuum induced upward deformation of the flexible bottom wall 65*a* of recess 61*a* and thus avoid constriction of the air-flow path by the force of the vacuum. Element 67*a* may have a circular planar horizontal bottom wall 68*a* and a cylindrical side wall 69*a*, with interruptions 71*a* in the side wall to allow flow of air and particles from the passage or passages 60*a*'' into recess 61*a***.

In both forms of the invention, means may be provided for assuring proper rotary orientation of the pad relative to the driving mechanism and shroud 15, to properly locate opening 41 or **41*a* of the pad in alignment with suction tubes 32 and 42. In accordance with the teachings of my above mentioned prior application Ser. No. 6/830,574, these aligning means may include three projections 72 formed on the underside of shroud 15 and projecting downwardly into locating recesses or openings 73 or 73*a* formed in plate 40 or 40*a*. As also taught in that prior application, there may be communicating openings 74 and 75 or 75*a* in the underside of shroud 15 and in plate 40 or 40*a* for placing the interior of the shroud in communication with passages 60 or 60*a* in the pad (as through an auxiliary passage 160 or 160*a*), in a manner allowing the force of the suction to also draw air from the interior of the shroud into the passages in the pad and then upwardly through tubes 42 and 32** to the collection location.

While certain specific embodiments of the present invention have been disclosed as typical, the invention is of course not limited to these particular forms, but rather is applicable broadly to all such variations as fall within the scope of the appended claims.

I claim:

1. A powered abrading tool comprising:

a body;

a motor carried by said body; and a unit which is adapted to carry a sheet of abrading material and is actuated relative to said body by said motor to abrade a work surface, and which includes a cushion of resiliently deformable material backing up said sheet of abrading material;

said cushion containing passages through which air and particles abraded from the work surface are drawn by vacuum from a location near the work surface through the interior of the cushion to a recess in the cushion from which the air and particles are drawn upwardly by vacuum; and an element which is stiffer than said deformable material of the cushion and is located at said recess and resists flow restricting deformation of said resiliently deformable material of the cushion at the recess by the force of the vacuum.

2. An abrading tool as recited in claim 1, in which said cushion has a portion formed of said resiliently deformable material extending across the underside of said recess and forming a bottom wall thereof, said element being constructed and positioned to resist upward movement of said bottom wall of the recess by the force of the vacuum.

3. An abrading tool as recited in claim 1, in which said cushion has a portion formed of said resiliently deformable material extending across the underside of said recess and forming a bottom wall thereof, said element stiffer than said deformable material of the cushion extending across the upper side of said flexible bottom wall of the recess to resist upward deflection thereof by the force of the vacuum.

4. An abrading tool as recited in claim 1, in which said resiliently deformable material of the cushion has a portion extending across the underside of said recess and defining a flexible bottom wall thereof, said resiliently deformable material having portions extending upwardly at different sides of said recess and forming side walls thereof, said element which is stiffer than said deformable material of the cushion having a bottom wall extending across the upper side of said flexible bottom wall of the recess and resisting upward deflection thereof, and having a side wall or walls projecting upwardly from said bottom wall of the element at the inner side of said side walls of the recess.

5. An abrading tool as recited in claim 1, in which said recess is essentially circular in horizontal section, and said element which is stiffer than said deformable material has a bottom wall resisting upward deflection of said deformable material at the bottom of the recess, and has a side wall of essentially circular horizontal section projecting upwardly from the periphery of said bottom wall of said element.

6. An abrading tool as recited in claim 1, in which said unit includes a backing plate extending across the upper side of and more rigid than said cushion and containing an opening which is upwardly opposite said recess and through which said air and particles are drawn upwardly by vacuum.

7. An abrading tool as recited in claim 6, including a suction tube carried by said body and slidably engaging said plate about said opening to draw air and particles upwardly through the opening and from said recess.

8. An abrading tool as recited in claim 7, in which said element which is stiffer than said deformable material of the cushion has a bottom wall extending across the upper side of a bottom wall of said recess and resisting upward deflection thereof, and has a side wall projecting upwardly from the periphery of said bottom wall of the element and toward said plate.

9. An abrading tool as recited in claim 6, in which said element which is stiffer than said deformable material of the cushion has a bottom wall extending across the upper side of a bottom wall of said recess and resisting upward deflection thereof, and has a side wall projecting upwardly from the periphery of said bottom wall of the element and toward said plate.

10. An abrading tool as recited in claim 1, in which said resiliently deformable material of the cushion is a foam material.

11. An abrading tool as recited in claim 1, in which at least some of said passages are formed in the upper surface of said cushion of resiliently deformable material, said unit including a plate more rigid than said resiliently deformable material and extending across and secured to the upper side of said cushion and closing upper sides of said passages, said plate containing an opening upwardly opposite said recess through which air and abraded particles are withdrawn upwardly from said unit, said element which is stiffer than said deformable material of the cushion being located in the recess beneath said opening in said plate and having a bottom wall extending across and resisting upward deflection of a bottom wall of the recess, and having a side wall extending along the periphery of said bottom wall of said element and projecting upwardly therefrom toward said plate.

12. An abrading tool as recited in claim 11, in which said side wall of said element has at least: one interruption through which one or more of said passages communicates with said recess to deliver air and particles thereto.

13. A pad adapted to be attached to a power unit of an abrading tool, and adapted to carry a sheet of abrading material and to be actuated by said power unit to abrade a workpiece, said pad comprising:

a cushion of resiliently deformable material for backing up the abrading material;

a plate more rigid than said resiliently deformable material of the cushion and extending across the upper side thereof, and having an opening through which the shank of a threaded fastener can extend for connection to said power unit to detachably secure the pad thereto; and a lock washer carried by said plate and cushion at the underside of said plate and containing an opening through which said shank of the fastener can extend, and having a portion against which an enlarged head of this fastener bears upwardly to secure the head to said power unit;

said washer being secured to the plate and cushion for handling therewith, and being retained against separation therefrom in handling prior to attachment of the pad to the power unit by said fastener.

14. A pad as recited in claim 13, in which said washer has a peripheral portion received vertically between said plate and said cushion in a relation securing the washer thereto.

15. A pad as recited in claim 13, in which said washer is a belleville washer.

16. A pad as recited in claim 13, in which said cushion contains an opening beneath said opening in said plate for receiving said head of the fastener, said washer being a belleville washer having a peripheral edge confined vertically between said plate and said deformable material of said cushion and having a diameter greater than said opening in said cushion.

17. A sanding pad adapted to carry a sheet of abrading material and which is adapted to be actuated by a motor of a powered abrading tool relative to a body of the tool to abrade a work surface; said pad comprising:

a cushion of resiliently deformable material for backing up said sheet of abrading material;

said cushion containing passages through which air and particles abraded from the work surface are drawn by vacuum from a location near the work surface through the interior of the cushion to a recess in the cushion from which the air and particles are drawn upwardly by vacuum; and an element which is stiffer than said deformable material of the cushion and is located at said recess and resists flow restricting deformation of said resiliently deformable material of the cushion at the recess by the force of the vacuum.

18. A sanding pad as recited in claim 17, in which said cushion has a portion formed of said resiliently deformable material extending across the underside of said recess and forming a bottom wall thereof, said element being constructed and positioned to resist upward movement of said bottom wall of the recess by the force of the vacuum.

19. A sanding pad as recited in claim 17, in which said resiliently deformable material of the cushion has a portion extending across the underside of said recess and defining a flexible bottom wall thereof, said resiliently deformable material having portions extending upwardly at different sides of said recess and forming side walls thereof, said element which is stiffer than said deformable material of the cushion having a bottom wall extending across the upper side of said flexible bottom wall of the recess and resisting upward deflection thereof, and having a side wall or walls projecting upwardly from said bottom wall of the element at the inner side of said side walls of the recess.

20. A sanding pad as recited in claim 17, in which said recess is essentially circular in horizontal section, and said element which is stiffer than said deformable material has a bottom wall resisting upward deflection of said deformable material at the bottom of the recess, and has a side wall of essentially circular horizontal section projecting upwardly from the periphery of said bottom wall of said element.

21. A sanding pad as recited in claim 17, including a backing plate extending across the upper side of and more rigid than said cushion and containing an opening which is upwardly opposite said recess and through which said air and particles are drawn upwardly by vacuum.

22. A sanding pad as recited in claim 21, in which said element which is stiffer than said deformable material of the cushion has a bottom wall extending across the upper side of a bottom wall of said recess and resisting upward deflection thereof, and has a side wall projecting upwardly from the periphery of said bottom wall of the element and toward said plate.

23. A sanding pad as recited in claim 17, in which said resiliently deformable material of the cushion is a foam material.

24. A sanding pad as recited in claim 17, in which at least some of said passages are formed in the upper surface of said cushion of resiliently deformable material, said pad including a plate more rigid than said resiliently deformable material and extending across and secured to the upper side of said cushion and closing upper sides of said passages, said plate containing an opening upwardly opposite said recess through which air and abraded particles are withdrawn upwardly from said pad, said element which is stiffer than said deformable material of the cushion being located in the recess beneath said opening in said plate and having a bottom wall extending across and resisting upward deflection of a bottom wall of the recess, and having a side wall extending along the periphery of said bottom wall and projecting upwardly therefrom toward said plate.

25. A sanding pad as recited in claim 24, in which said side wall of said element has at least one interruption through which one or more of said passages communicates with said recess to deliver air and particles thereto.

* * * * *